US007141141B1

(12) United States Patent
Koskinen et al.

(10) Patent No.: US 7,141,141 B1
(45) Date of Patent: Nov. 28, 2006

(54) APPARATUS AND METHOD FOR DETERMINATION AND CONTROL OF PAPER WEB QUALITIES ON A PAPERMAKING MACHINE

(75) Inventors: Pekka Koskinen, Kotka (FI); Esa Virtanen, Turku (FI); Ilpo Pitkaniemi, Kotka (FI); Jari Ristola, Kotka (FI)

(73) Assignee: EV Group Oy, Karhula (FI)

( * ) Notice: Subject to any disclaimer, the term of this patent is extended or adjusted under 35 U.S.C. 154(b) by 321 days.

(21) Appl. No.: 10/129,140

(22) PCT Filed: Nov. 2, 2000

(86) PCT No.: PCT/FI00/00957

§ 371 (c)(1),
(2), (4) Date: Jul. 2, 2002

(87) PCT Pub. No.: WO01/32980

PCT Pub. Date: May 10, 2001

(30) Foreign Application Priority Data

Nov. 3, 1999 (FI) ..... 19992375

(51) Int. Cl.
*D21F 11/00* (2006.01)

(52) U.S. Cl. ..... 162/198; 162/263; 162/252; 34/446; 73/61.48; 73/61.54

(58) Field of Classification Search ..... 162/198, 162/263, 252; 34/446; 73/61.48, 61.54
See application file for complete search history.

(56) References Cited

U.S. PATENT DOCUMENTS 2,177,558 A * 10/1939 Callan, Jr. ..... 73/73
3,801,426 A 4/1974 Putman et al.
5,377,428 A 1/1995 Clark
5,465,504 A 11/1995 Joiner

* cited by examiner

*Primary Examiner*—Mark Halpern
(74) *Attorney, Agent, or Firm*—Birch, Stewart, Kolasch & Birch, LLP

(57) ABSTRACT

The invention relates to an apparatus for the on-line determination of paper web moisture content and/or temperature on the dryer section of a papermaking machine. The apparatus is designed to form, in combination with a doctor means and/or a packet ventilating tube, such a compact structure wherein the apparatus operates underneath such means or in a close proximity thereto. The invention also relates to a method for control of paper web moisture content and temperature on the basis of measurements performed on the dryer section of a papermaking machine.

15 Claims, 1 Drawing Sheet

APPARATUS AND METHOD FOR DETERMINATION AND CONTROL OF PAPER WEB QUALITIES ON A PAPERMAKING MACHINE

This application is the national phase under 35 U.S.C. § 371 of PCT International Application No. PCT/FI00/00957 which has an International filing date of Nov. 2, 2000, which designated the United States of America, and which claims priority to Application Ser. No. 19992375 in Finland, filed on Nov. 3, 1999.

BACKGROUND OF THE INVENTION

Field of the Invention

The present invention relates to an apparatus for determination of paper web qualities during the manufacture of the web and a method for utilizing the apparatus.

DESCRIPTION OF THE BACKGROUND

On a papermaking machine, the moisture content of the web generally is in the order of 55% after the press section, which means that more than half of the web weight at this stage still is water. The cross-direction moisture profile of the web as it leaves the press has been found to affect the tensional cross-direction profile of the web at the winder. Further, it has been experimentally found that the shape of the web tension profile measured at the winder is also reflected in the web profile downstream through the web finishing steps and even up to runs in the printing machine. Obviously, an uneven web tension profile causes problems, one of which is evidenced as breaks of the web running in the papermaking machine, the finishing equipment or the printing machine.

As to the general state of the art, reference is made to patent publication FI 62571, wherein is described the adaptation of a blow tube to operate with the doctor blade or in a close proximity thereof. Furthermore, it is known in the art to measure the qualifies of the running web at the papermaking machine after the dryer section but before the winder.

Today, the end value of the web moisture profile is measured at a scanning beam located after the dryer section, whereby it is attempted to control the profile as uniform as possible utilizing a steam box located within the press section, unsymmetrical loading of the press and a wetting unit located within the dryer section or immediately after the same. Possible deviations in the cross-direction moisture profile remaining in the web after the press section are diminished in the dryer section, because the evaporation of the few last percent units of the residual moisture content demands a substantially high amount of energy input, which in most papermaking machines gives an end moisture content as low as 2%, whereby deviations from a uniform cross-direction moisture profile remain insignificant. This processing approach involves such unnecessary steps as overdrying on a portion of the web and subsequent rewetting thereof in order to keep the moisture profile of the finished web within preset limits. Obviously, such overdrying increases the specific energy consumption and elevates the costs of papermaking. It is also possible that the drying effect imposed on the web by the dryer section gives an inhomogeneous result due to soiled dryer cylinders or uneven ventilation, thus affecting in a substantial manner the moisture content profile of the web as it leaves the press section. A further factor complicating the situation is that the outcome of any control action performed on the units of the press section is detectable with a long delay only at the scanning beam which is located in front of the winder. As modern papermaking machines are designed for ever faster web speeds up to 2000 m/min, the dryer section must respectively be made longer than in the prior art, whereby changes occurring on the wet end of the papermaking machine can be sensed at the scanning beam, which is located downstream from the dryer section, with a delay longer than that customary in the prior art. Due to these reasons, it is desirable to measure the qualities of the paper web, such as its moisture content and temperature, already on the dryer section, most advantageously immediately downstream from the press section.

A problem hampering flawless operation of measurement equipment and instrumentation located on the cylinder dryer section is the accumulation of paper web debris during web breaks into all possible locations on the beams, tubes and the like elements typically needed in the system when these elements are located under the dryer cylinders. Additionally, the high ambient temperature and humidity of the operating environment set specific demands on the measurement equipment and instruments.

BRIEF SUMMARY OF THE INVENTION

The goal of the embodiment according to the present invention is to eliminate the above-described complications. The characteristic features of the apparatus and method according to the invention are disclosed in the appended claims.

It is an object of the present invention to provide an apparatus for the measurement of paper web qualities, particularly the web moisture content and temperature essentially on the dryer section of a papermaking machine. The apparatus according to the invention may comprise a single measurement device or a plurality thereof adapted to measure the paper web qualities, particularly the web moisture content and/or temperature, whereby at least one of the devices is located on the dryer section of the papermaking machine, advantageously as close as possible to the press section thereof.

The measurement device used in the apparatus is generally known as a scanning beam. The construction and principle of operation of the scanning beam may vary according to specific needs. An essential requirement herein is that the scanning beam can operate reliably and accurately over its specified measurement span and to submit the information thus obtained to further processing, e.g. by a control means adapted to utilize the information. Most advantageously, the scanning beam has a construction enclosed in a box section beam that houses at least one sensor 10 adapted to move in the cross-machine direction over the web, whereby the sensor-actuating elements are located in the interior of a protective enclosure and only the lens portion 11 of the sensor(s) is flush with the exterior surface of the enclosure.

A preferred embodiment has the apparatus placed to operate in conjunction with a blow box 7 or a doctor 6 so close to said unit that no essential gap remains therebetween, thus achieving a construction free from the tendency of accumulating paper web debris or larger clumps of paper. The closed structure of the scanning beam is attained by way of adapting a seal belt 15 to the sensor(s) 10 so as to be movable therewith, whereby the belt seals the slot of the scanning beam at all other points except the instantaneous location of the sensor(s) 10. In another embodiment, there is mounted a sufficiently great number of the sensors 10 into a linear array, thus dispensing with the need to move the sensors in the cross machine direction in order to obtain scanning results essentially over the entire width of the web 9.

Any mechanical device located on the dryer section is hampered by the accumulation of dirt and condensation on the moving parts of the device that may cause jamming the movement of the device and put it out of function. In the embodiment according to the invention, the scanning beam is equipped with air feed means 12 for blowing air into the interior of the beam in order to stabilize the temperature of the scanning beam and, additionally, to maintain the interior of the scanning beam by means of the air feed at a pressurized level in regard to the ambient pressure thus preventing dirt from entering the interior of the box-section beam. This arrangement provides a reasonable operating environment in the interior of the scanning beam for the sensor 10 enclosed therein, the sensor-moving parts and other components that are sensitive to the attack of dirt and humidity.

Under certain conditions, the temperature of ventilating air blown into the interior of the scanning beam is arranged to be controlled on the basis of the information obtained from a temperature sensor located in the interior of the scanning beam so as to keep the ambient temperature in the interior of the beam at a constant level. For this purpose, the air used for ventilating the beam must be heated or cooled as required by means of a heat exchanger arranged to operate in conjunction with the ventilation air equipment In certain applications, it is advantageous to provide the scanning beam with an elevating/lowering system, later called a lift actuator 18, by means of which the scanning beam can be lowered for maintenance operations to sufficiently large distance away from its operating position close to the dryer cylinders, thus positioning the beam at a suitable height from, e.g., floor level of the machine service dump.

The operation of the lift actuator 18 may also be connected to the paper-making process so that, at a web break, the scanning beam moves from its normal scanning distance to a safety distance from the paper web so as to provide during a web break occurring at the dryer cylinder just upstream or downstream from the scanning beam an unobstructed fall-down path of the broke into the machine dump.

BRIEF DESCRIPTION OF THE DRAWINGS

In the following, the invention will be described in more detail with reference to the appended drawings in which FIGS. 1–4 describe a few exemplifying embodiments according to the invention.

DETAILED DESCRIPTION OF THE INVENTION

Figure 1:
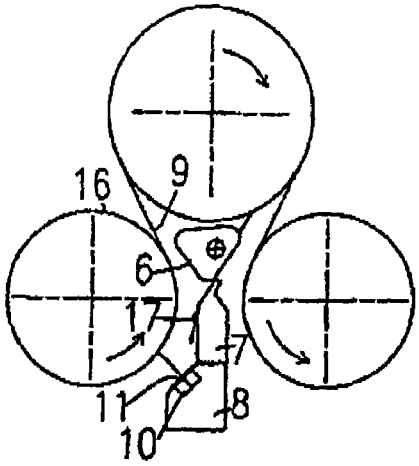
Figure 2:
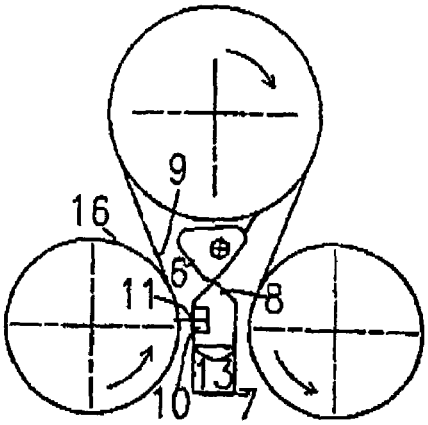
Figure 3:
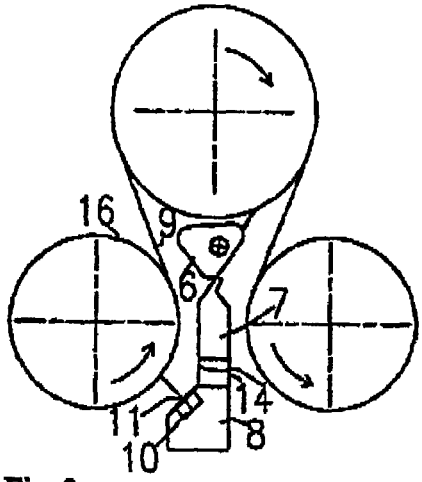
Figure 4:
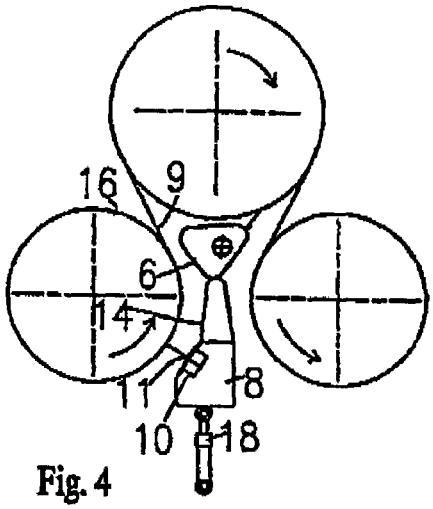

Depending on the structure of the dryer section in the papermaking machine, the arrangement of the equipment counting from top downward could be as is shown in FIG. 1 comprising a doctor 6, a blow tube 7, a scanning beam 8, or alternatively, as shown in FIG. 2 comprising a doctor 6, a scanning beam 8, a blow tube 7 or further alteratively, such as shown in FIGS. 3 and 4.

Now referring to FIG. 1, therein is shown an exemplifying embodiment of the invention. Under a dryer cylinder is disposed a doctor 6 having a blow tube 7 mounted there-under. Immediately beneath this subassembly, there is adapted a box-section scanning beam 8 that senses the moisture content and temperature of the running web 9. In FIG. 1 is also shown a possible rinsing spray 17 serving to flush away with a cleaning medium any paper web debris remaining in front of the scanning beam after a web break.

In FIG. 2 is shown a practicable arrangement, wherein to the underside of the dryer cylinder is placed a doctor 6 having a scanning beam 8 located there-under. Immediately under the latter, there is placed a blow tube 7. At a web break, the blow tube injects air from nozzles 13 that detaches paper web debris from the surface of the measurement equipment. Also during measurement in a normal running condition, the blow tube ejects dry air into the spaces remaining between the doctor 6, the scanning beam 8, the blow tube 7, the dryer cylinder 16 and the web 9, thus removing excess humidity to assure a problem-free measurement environment.

In FIG. 3 is shown a practicable arrangement for tight machine layouts that prevent the scanning beam 8 from being located to a close proximity of the blow tube 7. In this case, plates or the like elements 14 are placed between the blow tube 7 and the scanning beam 8 so as to configure the scanning beam with the blow tube into an integrated structure.

In FIG. 4 is shown a practicable arrangement for tight machine layouts that prevent the scanning beam 8 from being located to a close proximity of the doctor 6. In this case,.plates or the like elements 14 are placed between the doctor 6 and the scanning beam 8 so as to configure the scanning beam 8 with the doctor 6 into an integrated structure.

Figure 5:
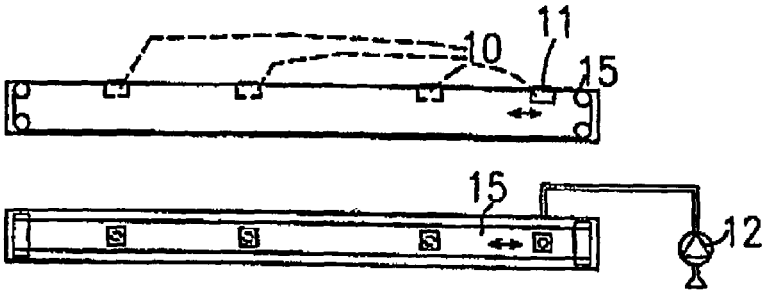
FIG. 5 shows a schematic view of the construction and operation principle of the scanning beam.

In FIG. 5 is schematically shown the box-section structure of the scanning beam 8. All the essential parts are enclosed in the box-section interior of the scanning beam. The scanning beam houses one or a greater number of sensors, whereby the sensor slot of the scanning beam is covered by means of a seal belt 15 over all other points except the instantaneous location of the sensor(s) that is/are moved in the cross-machine direction so that the above-mentioned web qualities can be measured over the entire cross-machine width.

The invention also relates to a method for determination of paper web qualities during the manufacture of the paper web. In the method according to the invention, the determination of paper web qualities, more particularly web moisture content and temperature, is performed from the web profiles that are measured in the cross-machine direction and/or machine direction, specifically on the dryer section of a papermaking machine.

The most preferred embodiment of the method according to invention can be implemented by way of performing the determination of paper web moisture content and temperature on the dryer section of a papermaking machine, particularly advantageously as close as possible to the press section. The goal in measuring the paper web qualities advantageously immediately downstream from the press section is that herein the effect of the dryer section is still insignificant, thus allowing any unevenness possibly occurring in the web moisture profile to be detected in an undisturbed manner. Based on such moisture profile information, it is possible to control the operation of the headbox, steam box and/or press section so that the paper web attains a moisture profile of a desired shape at the entry of the web into the dryer section in order to achieve an optimal web tension profile, among other benefits. As the present arrangement allows the scanning beam to be located in a very close proximity to the press section, the response of control actions can be made substantially faster and more accurate than what is possible in a conventional control of the headbox, steam box and press section that is based on measurement information obtained downstream from the dryer section.

By virtue of performing the moisture profile measurement immediately down-stream from the press section, it is also possible after the measurement to carry out, e.g., by means of an afterwetting unit, correction of a defective moisture profile detected in the measurement, thus preventing a web of defective moisture profile from reaching the upwinder. Hence, the arrangement according to the invention facilitates web moisture profile control in a realtime fashion, if so desired, either on the wire section, on the press section or as well on the dryer section, or after any of these, most advantageously utilizing an afterwetting unit for the control.

To those skilled in the art it is obvious that the invention is not limited by the embodiments described above, but rather, can be varied within the scope and spirit of the appended claims. Accordingly, the invention may also be applied to other machines such as cardboard machines operating in a similar manner as a papermaking machine.

What is claimed is:

1. Apparatus for on-machine determination of paper web qualities during the manufacture of said paper web, comprising:

a dryer section of a papermaking machine;

a scanning beam measurement device located in said dryer section for determining profiles of paper web qualities measured in a given direction; and said scanning beam measurement device being located in substantially close proximity to a doctor element or blow tube so as to form an integrated structure therewith;

said scanning beam measurement device providing a scanning beam for scanning said paper web, including at least one sensor, whereby the sensor and its actuating elements are located in the interior of a box-section beam enclosure so as to leave only a lens portion of the sensor flush with the exterior surface of the enclosure, said box-section beam enclosure having a sealed structure and being provided with ventilation air blowing equipment serving to keep the interior space of the beam at a controlled temperature and pressurized atmosphere in regard to the ambient environment.

2. Apparatus according to claim 1, wherein said apparatus includes at least one scanning beam (8) measurement device suitable for determination of paper web qualities, whereby at least one of said at least one scanning beam measurement device is located on the dryer section of the papermaking machine, close to the press section thereof.

3. Apparatus according to claim 1, wherein said apparatus is located underneath a doctor element holder beam or in a close proximity thereto or, alternatively, underneath an air-distribution means connected to said doctor element holder beam or in a close proximity thereto.

4. Apparatus according to claim 1, further comprising a scanning beam (8) located in a substantially close proximity to a doctor element or a blow tube so as to form an integrated structure therewith, either directly or via plate elements (14).

5. Apparatus according to claim 1, wherein a flow of blown air passes between a lens of the measurement device and the web being scanned, so as to sweep through the area scanned by a beam of light in order to keep moisture and dust away from said lens and said beam of light.

6. Apparatus according to claim 1, further comprising a lift/transfer means for setting the scanning beam to measuring, safety and servicing distances from the web being scanned.

7. Apparatus according to claim 1, further comprising a rinsing spray tube above a scanning beam extending over the cross-machine length of said scanning beam and particularly adapted to operate on the side having the beam of light thereon.

8. Apparatus according to claim 1, wherein the direction is a cross-machine direction.

9. Apparatus according to claim 1, wherein the direction is a machine direction.

10. Method for on-machine determination of paper web qualities during the manufacture of said paper web, comprising the steps of:

determining profiles of paper web qualities in a measurement direction of the web, which is on the dryer section of the papermaking machine;

locating a scanning beam measurement device for determining said profiles in a substantially close proximity to a doctor element or blow tube so as to form an integrated structure therewith;

said scanning beam measurement device providing a scanning beam for scanning said paper web, including at least one sensor, whereby the sensor and its actuating elements are located in the interior of a box-section beam enclosure so as to leave only a lens portion of the sensor flush with the exterior surface of the enclosure, said box-section beam enclosure having a sealed structure and being provided with ventilation air blowing equipment serving to keep the interior space of the beam at a controlled temperature and pressurized atmosphere in regard to the ambient environment.

11. Method according to claim 10, wherein the scanning beam (8) is located on the dryer section of the papermaking machine, close to the press section thereof.

12. Method according to claim 10, wherein the paper web qualities measurement information is utilized in a realtime fashion during the manufacture of the paper web.

13. Method according to claim 10, wherein a headbox, wire section, press section, dryer section, a steambox and/or an afterwetting unit is/are controlled on the basis of the thus obtained measurement information, related to the moisture content and/or temperature of the web, so as to achieve a desired end result.

14. Method according to claim 10, wherein the direction is a cross-machine direction.

15. Method according to claim 10, wherein the direction is a machine direction.

* * * * *